US009534781B2

(12) United States Patent
Hughes et al.

(10) Patent No.: US 9,534,781 B2
(45) Date of Patent: Jan. 3, 2017

(54) SYSTEM AND METHOD HAVING MULTI-TUBE FUEL NOZZLE WITH DIFFERENTIAL FLOW

(75) Inventors: Michael John Hughes, Greer, SC (US); Thomas Edward Johnson, Greer, SC (US); Jonathan Dwight Berry, Simpsonville, SC (US); William David York, Greer, SC (US)

(73) Assignee: General Electric Company, Schenectady, NY (US)

( * ) Notice: Subject to any disclaimer, the term of this patent is extended or adjusted under 35 U.S.C. 154(b) by 1116 days.

(21) Appl. No.: 13/468,988

(22) Filed: May 10, 2012

(65) Prior Publication Data

US 2013/0299602 A1 Nov. 14, 2013

(51) Int. Cl.

| | |
|---|---|
| ***F23R 3/04*** | (2006.01) |
| ***F23N 3/08*** | (2006.01) |
| ***F23R 3/26*** | (2006.01) |
| ***F23R 3/28*** | (2006.01) |

(52) U.S. Cl.

CPC ..... *F23N 3/082* (2013.01); *F23R 3/045* (2013.01); *F23R 3/26* (2013.01); *F23R 3/286* (2013.01)

(58) Field of Classification Search

CPC ..... F23R 3/045; F23R 3/20; F23R 3/26; F23R 3/283; F23R 3/286; F23R 2900/03044

USPC ..... 60/69.23

See application file for complete search history.

(56) References Cited

U.S. PATENT DOCUMENTS

| | | | | |
|---|---|---|---|---|
| 4,100,733 | A | 7/1978 | Striebel et al. | |
| 4,357,991 | A | 11/1982 | Cameron | |
| 4,413,394 | A | 11/1983 | Small | |
| 4,722,181 | A | 2/1988 | Yu | |
| 5,213,494 | A | 5/1993 | Jeppesen | |
| 5,638,682 | A | 6/1997 | Joshi et al. | |
| 6,530,223 | B1 | 3/2003 | Dodds et al. | |
| 6,808,017 | B1 | 10/2004 | Kaellis | |
| 6,813,889 | B2 * | 11/2004 | Inoue | F23R 3/10 60/737 |
| 6,880,340 | B2 | 4/2005 | Saitoh | |
| 6,928,823 | B2 * | 8/2005 | Inoue | F02C 7/22 60/737 |
| 8,234,872 | B2 | 8/2012 | Berry et al. | |
| 8,322,143 | B2 | 12/2012 | Uhm et al. | |

(Continued)

FOREIGN PATENT DOCUMENTS

| | | | |
|---|---|---|---|
| CN | 101725985 | A | 6/2010 |
| CN | 101793400 | A | 8/2010 |

(Continued)

OTHER PUBLICATIONS

U.S. Appl. No. 13/277,516, filed Oct. 20, 2011, Chunyang Wu et al.

(Continued)

*Primary Examiner* — Arun Goyal

(74) *Attorney, Agent, or Firm* — Fletcher Yoder P.C.

(57) ABSTRACT

A system includes a multi-tube fuel nozzle with a fuel nozzle body and a plurality of tubes. The fuel nozzle body includes a nozzle wall surrounding a chamber. The plurality of tubes extend through the chamber, wherein each tube of the plurality of tubes includes an air intake portion, a fuel intake portion, and an air-fuel mixture outlet portion. The multi-tube fuel nozzle also includes a differential configuration of the air intake portions among the plurality of tubes.

14 Claims, 10 Drawing Sheets

(56) References Cited

U.S. PATENT DOCUMENTS

| | | | | |
|---|---|---|---|---|
| 8,550,809 | B2 * | 10/2013 | Uhm et al. | 431/8 |
| 8,701,419 | B2 | 4/2014 | Hughes | |
| 8,904,797 | B2 | 12/2014 | Berry et al. | |
| 9,243,803 | B2 | 1/2016 | Berry et al. | |
| 2009/0031728 | A1 | 2/2009 | Miura et al. | |
| 2010/0218501 | A1 | 9/2010 | York et al. | |
| 2010/0323309 | A1 * | 12/2010 | Barkowski et al. | 431/8 |
| 2012/0036856 | A1 | 2/2012 | Uhm et al. | |
| 2012/0079829 | A1 | 4/2012 | Berry et al. | |
| 2012/0180487 | A1 | 7/2012 | Uhm et al. | |
| 2013/0025285 | A1 | 1/2013 | Stewart et al. | |
| 2013/0232979 | A1 | 9/2013 | Singh | |
| 2014/0260267 | A1 | 9/2014 | Melton et al. | |
| 2014/0260268 | A1 | 9/2014 | Westmoreland et al. | |
| 2014/0260271 | A1 | 9/2014 | Keener et al. | |
| 2014/0260276 | A1 | 9/2014 | Westmoreland et al. | |
| 2014/0260299 | A1 | 9/2014 | Boardman et al. | |
| 2014/0260300 | A1 | 9/2014 | Chila et al. | |
| 2014/0260315 | A1 | 9/2014 | Westmoreland et al. | |
| 2014/0283522 | A1 | 9/2014 | Boardman et al. | |
| 2014/0338338 | A1 | 11/2014 | Chila et al. | |
| 2014/0338339 | A1 | 11/2014 | Westmoreland et al. | |
| 2014/0338340 | A1 | 11/2014 | Melton et al. | |
| 2014/0338344 | A1 | 11/2014 | Stewart et al. | |
| 2014/0338354 | A1 | 11/2014 | Stewart et al. | |
| 2014/0338355 | A1 | 11/2014 | Stewart et al. | |
| 2014/0338356 | A1 | 11/2014 | Keener et al. | |

FOREIGN PATENT DOCUMENTS

| | | | |
|---|---|---|---|
| CN | 101799162 | A | 8/2010 |
| CN | 103062796 | A | 4/2013 |
| EP | 2216599 | A2 | 9/2010 |
| EP | 2224172 | A2 | 9/2010 |
| EP | 2378202 | A2 | 10/2011 |

OTHER PUBLICATIONS

Jian Wen, Yanzhong Li, Aimin Zhou, Ke Zhang, "An experimental and numerical investigation of low patterns in the entrance of plate-fin heat exchanger," International Journal of Heat and Mass Transfer, Jan. 19, 2006, p. 1667, vol. 49.

Extended European Search Report for EP Application 13167264.4-1602 dated Aug. 20, 2013.

CN Office Action; Application No. CN201310170581.9; Dated Feb. 5, 2016; 7 Pages.

* cited by examiner

SYSTEM AND METHOD HAVING MULTI-TUBE FUEL NOZZLE WITH DIFFERENTIAL FLOW

STATEMENT REGARDING FEDERALLY SPONSORED RESEARCH & DEVELOPMENT

This invention was made with Government support under contract number DE-FC26-05NT42643 awarded by the Department of Energy. The Government has certain rights in the invention.

BACKGROUND OF THE INVENTION

The subject matter disclosed herein relates to gas turbine engines and more specifically, to nozzles of gas turbine engines.

A gas turbine engine combusts a mixture of fuel and air to generate hot combustion gases, which in turn drive one or more turbine stages. In particular, the hot combustion gases force turbine blades to rotate, thereby driving a shaft to rotate one or more loads, e.g., an electrical generator. The gas turbine engine includes a fuel nozzle to inject fuel and air into a combustor. In certain configurations, fuel and air are pre-mixed prior to ignition to reduce emissions and improve combustion. Unfortunately, fuel and air may be injected with flow characteristics that may lead to non-uniform temperatures or emissions across the fuel nozzle.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a multi-tube fuel nozzle with a fuel nozzle body and a plurality of tubes. The fuel nozzle body includes a nozzle wall surrounding a chamber. The plurality of tubes extend through the chamber, wherein each tube of the plurality of tubes includes an air intake portion, a fuel intake portion, and an air-fuel mixture outlet portion. The multi-tube fuel nozzle also includes a differential configuration of the air intake portions among the plurality of tubes.

In a second embodiment, a system includes a multi-tube fuel nozzle with a fuel nozzle body and a plurality of tubes. The fuel nozzle body includes a nozzle wall surrounding a chamber. The plurality of tubes extend through the chamber, wherein the multi-tube fuel nozzle comprises a differential configuration of air intake portions among the plurality of tubes. The differential configuration is configured to control a flow distribution among the plurality of tubes.

In a third embodiment, a method includes receiving fuel into a plurality of tubes extending through a body of a multi-tube fuel nozzle. The method also includes receiving air differentially into the plurality of tubes through a respective plurality of air intake portions, wherein the multi-tube fuel nozzle comprises a differential configuration of the air intake portions among the plurality of tubes. The method further includes outputting an air-fuel mixture from the plurality of tubes.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
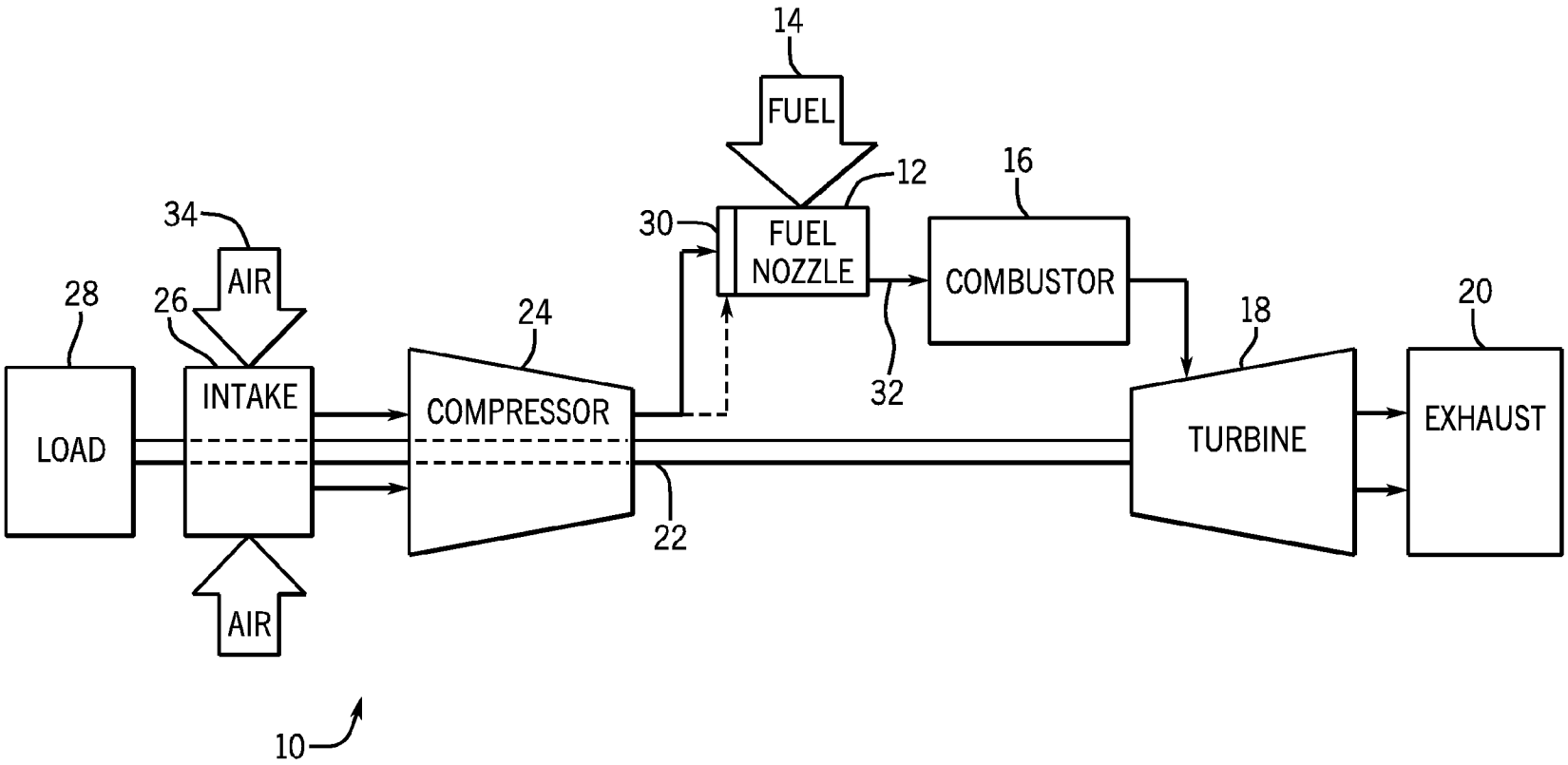
FIG. 1 is a block diagram of an embodiment of a turbine system including a multi-tube fuel nozzle with flow control features to control a flow distribution.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

A system and method for a multi-tube fuel nozzle with differential flow as described herein has a variety of possible air intake portions for each tube of the multi-tube fuel nozzle. Without the air intake portions as described herein, air may enter the upstream end of each tube of the multi-tube fuel nozzle in varying quantities and/or velocities. The air intake portions as described herein may affect the quantity and/or velocity of air entering or exiting each tube so as to provide a desired exit flow (e.g., uniform flow) among multiple tubes (e.g., 2 to 1000 tubes). The air intake portions may include axial air inlets with differential shapes from one tube to another among the multiple tubes. For example, axial air inlets with a tapered entry shape (e.g., conical and/or counterbore entry shape) may permit more air to enter a tube at a greater velocity than an axial air inlet with a straight entry shape (e.g., cylindrical entry shape). The air intake portions may also include radial air inlets to inject air into at least some of the tubes to affect the exit flow of the air-fuel mixture from the tubes into the combustion region. In certain embodiments, the quantity, velocity, and pressure of the injected air may be dynamically adjusted during operation. The radial air inlets for each tube may vary in size, shape, number, angle, and pattern. For example, the radial air inlets for each tube may be arranged in a differential pattern to affect the quantity of air exiting each tube, the velocity of air of exiting each tube, or both the quantity and velocity of air exiting each tube. Each tube of the plurality of tubes may have more than one set of radial air inlets, such that air may be injected into one or more sets of radial air inlets at a time. The air intake portions may be configured to obtain a desired exit flow profile, such as a uniform profile among the multiple tubes, for the multi-tube fuel nozzle.

Turning now to the drawings and referring first to FIG. 1, a block diagram of an embodiment of a turbine system 10 is illustrated. As described in detail below, the disclosed turbine system 10 (e.g., a gas turbine engine) may employ one or more fuel nozzles 12 (e.g., multi-tube fuel nozzles) with differential air intake portions 30 configured to affect the air-fuel flow distribution across the fuel nozzle 12. For example, certain fuel nozzles 12 include different configurations of air intake portions 30 (e.g., tapered, curved, or straight axial entry shapes and/or different sizes, numbers, inlet angles, or patterns of radial air inlets) configured to affect the quantity and/or velocity of the air-fuel mixture 32 to be injected into the combustor 16. For example, these air intake portions 30 may direct air along a plurality of tubes (e.g., 2 to 1000 premixing tubes) downstream through a fuel nozzle body (e.g., fuel nozzle head) to be mixed with fuel 14 from a chamber. The air-fuel mixture 32 may be injected through a combustion face of each fuel nozzle 12. As a result, these air intake portions 30 may affect the quality, quantity, and/or velocity of the air-fuel mixture 32 exiting each tube across the fuel nozzle 12. Different configurations of the air intake portions 30 may affect properties of the air-fuel mixture 32 (including the fuel/air ratio) across the fuel nozzles 12 to create a desired air-fuel mixture profile, such as a uniform air-fuel mixture profile or another profile with a desired combustion efficiency. Reducing the non-uniformity of the air-fuel mixture profile among the tubes of a fuel nozzle 12 may reduce $NO_x$ emissions. In addition, these air intake portions 30 may enable specific air-fuel mixture profiles to richen certain tubes to act as pilots or to lean other tubes to reduce heat loading in critical areas. In certain embodiments, the system 10 includes a plurality of fuel nozzles 12 arranged around a central fuel nozzle 12. One or more of these fuel nozzles 12 may include the air intake portions 30 discussed in detail below.

The turbine system 10 may use liquid or gas fuel, such as natural gas and/or a hydrogen rich synthetic gas, to drive the turbine system 10. As depicted, one or more fuel nozzles 12 intake fuel 14, mix the fuel 14 with air 34, and distribute the air-fuel mixture 32 into the combustor 16 in a suitable ratio for optimal combustion, emissions, fuel consumption, and power output. The turbine system 10 may include one or more fuel nozzles 12 located inside one or more combustors 16. The air-fuel mixture 32 combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 may be connected to various components of the turbine system 10, including a compressor 24. The compressor 24 also includes blades coupled to the shaft 22. As the shaft 22 rotates, the blades within the compressor 24 also rotate, thereby compressing air 34 from an air intake 26 through the compressor 24 and into the fuel nozzles 12 and the combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of the turbine system 10.

Figure 2:
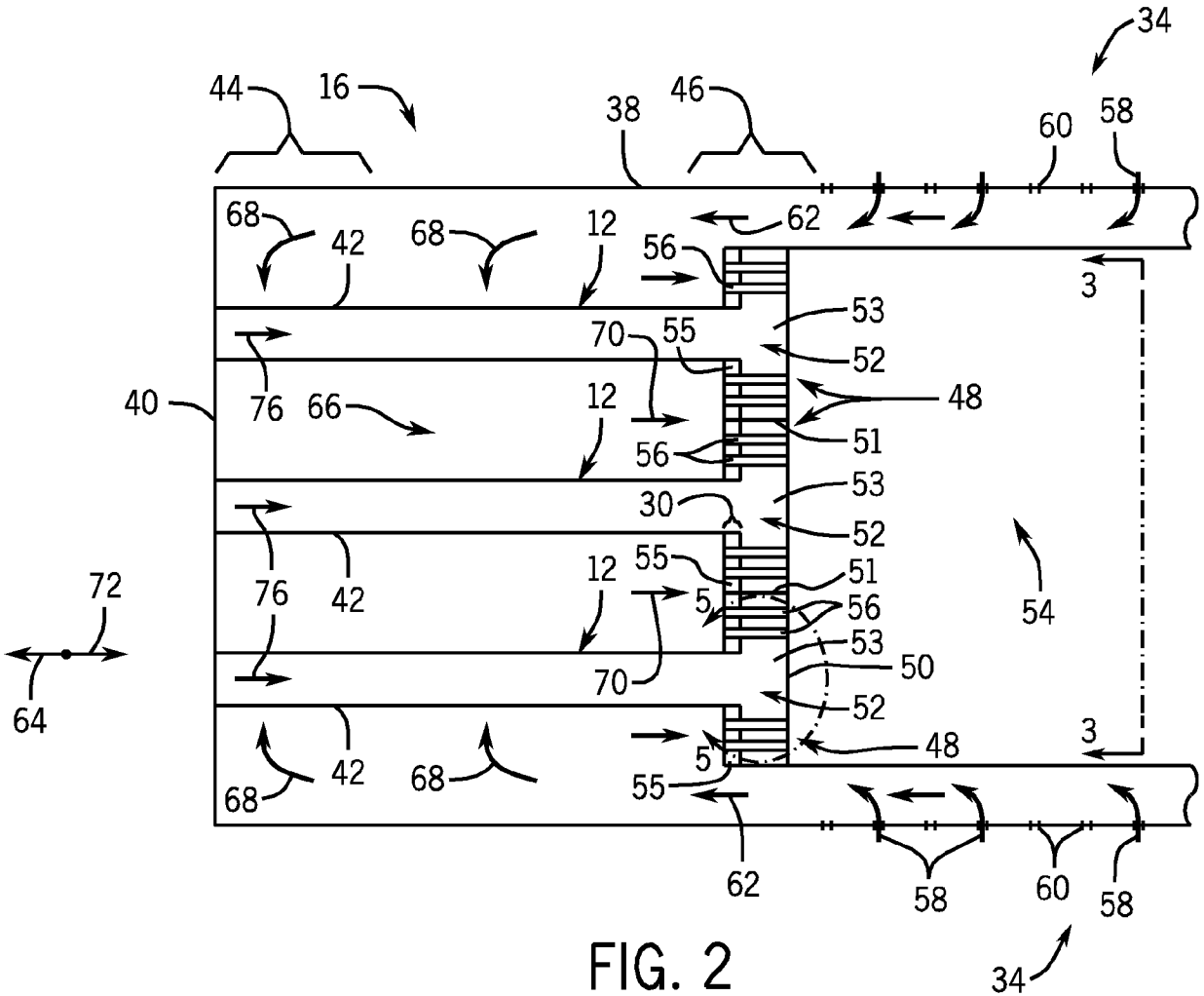
FIG. 2. is a cross-sectional side view of an embodiment of a combustor of the turbine system of FIG. 1 with a plurality of multi-tube fuel nozzles.

FIG. 2 is a cross-sectional side view of an embodiment of the combustor 16 of FIG. 1 with multiple fuel nozzles 12. The combustor 16 includes an outer casing or flow sleeve 38 and an end cover 40. Multiple fuel nozzles 12 (e.g., multi-tube fuel nozzles) are mounted within the combustor 16. Each fuel nozzle 12 includes a fuel conduit 42 extending from an upstream end portion 44 to a downstream end portion 46 of the nozzle 12. The downstream end portion 46 of each fuel nozzle 12 includes a fuel nozzle body 48 (e.g., fuel nozzle head) that includes a nozzle wall 50 and chamber wall 51 surrounding at least one chamber 52 (e.g., air distribution chamber, fuel chamber). In some embodiments, the nozzle wall 50 and the chamber wall 51 may define a fuel chamber 53 and one or more air distribution chambers 55. The nozzle wall 50 of each fuel nozzle body 48 is also configured to face a combustion region 54. In addition, each fuel nozzle 12 includes a plurality of tubes 56 (e.g., 2 to 1000 premixing tubes) extending through the at least one chamber 52 to the nozzle wall 50. In certain embodiments, the body 48 of each fuel nozzle 12 may include 2 to 1000, 10 to 500, 20 to 250, or 30 to 100 tubes 56 in a generally parallel arrangement. In the illustrated embodiment, the fuel conduit 42 extends through the air distribution chamber 55 and fuel chamber 53 parallel to the plurality of tubes 56 at a central region within the tubes 56 of the body 48 of each fuel nozzle 12.

Air 34 (e.g., compressed air) enters the flow sleeve 38 (as generally indicated by arrows 58) via one or more air entries 60 and follows an upstream airflow path 62 in an axial direction 64 towards the end cover 40. Air then flows into an interior flow path 66, as generally indicated by arrows 68, and proceeds along a downstream airflow path 70 in the axial direction 72 through the air intake portions 30 of the plurality of tubes 56 of each fuel nozzle 12. The air intake portion 30 of each tube of the plurality of tubes 56 may include an axial air inlet 202 and/or radial air inlets 260 as described in detail below with FIGS. 5-13. In some embodiments, each air intake portion 30 is selected to provide a desired air-fuel mixture for the fuel nozzle 12. Fuel 14 flows in the axial direction 72 along a fuel flow path 76 through each fuel conduit 42 towards the downstream end portion 46 of each fuel nozzle 12. Fuel 14 then enters the fuel chamber 52, 53 of each fuel nozzle 12 and mixes with air within the plurality of tubes 56 downstream of the air intake portion 30 as described in greater detail below. The fuel nozzles 12 inject the air-fuel mixture 32 into the combustion region 54 in a suitable ratio for optimal combustion, emissions, fuel consumption, and power output.

Figure 3:
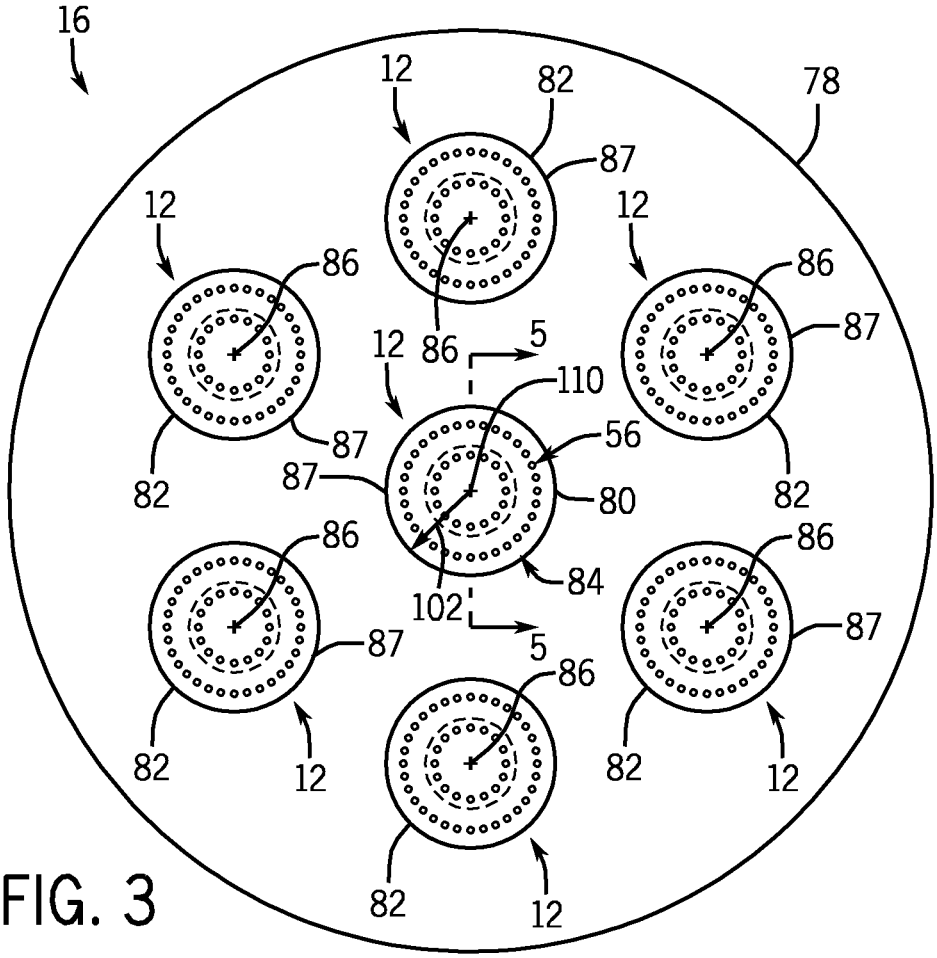
FIG. 3 is a front plan view of an embodiment of the combustor including a plurality of multi-tube fuel nozzles (e.g., circular-shaped)

FIG. 3 is a front plan view of an embodiment of the combustor 16 including multiple fuel nozzles 12 (e.g., multi-tube fuel nozzles). The combustor 16 includes a cap member 78 with multiple fuel nozzles 12 disposed there through. As illustrated, the combustor 16 includes a fuel nozzle 12 (e.g., center fuel nozzle 80) centrally located within the cap member 78 and coaxial with the central axis 110 of the combustor 16. The combustor 16 also includes multiple fuel nozzles 12 (e.g., outer fuel nozzles 82) disposed circumferentially about the center fuel nozzle 80. As illustrated, six outer fuel nozzles 82 surround the center fuel nozzle 80. However, in certain embodiments, the number of fuel nozzles 12 as well as the arrangement of the fuel nozzles 12 may vary. Each fuel nozzle 12 includes the plurality of tubes 56. As illustrated, the plurality of tubes 56 of each fuel nozzle 12 is arranged in multiple rows 84 (e.g., concentric rings of tubes 56). The rows 84 have a concentric arrangement about a central axis 86 of each fuel nozzle 12, and may extend in the radial direction 102 towards a fuel nozzle perimeter 87. In certain embodiments, the number of rows 84, number of tubes 56 per row 84, and arrangement of the plurality of tubes 56 may vary. In certain embodiments, each of the fuel nozzles 12 may include at least one of the differential configurations of air intake portions 30 mentioned above (e.g., axial air inlets and possibly radial air inlets). In certain embodiments, only the center fuel nozzle 80 may include differential air intake portions 30. Alternatively, in certain embodiments, only the outer fuel nozzles 82 may include differential air intake portions 30. In some embodiments, both the center and outer fuel nozzles 80 and 82 may include differential air intake portions 30.

Figure 4:
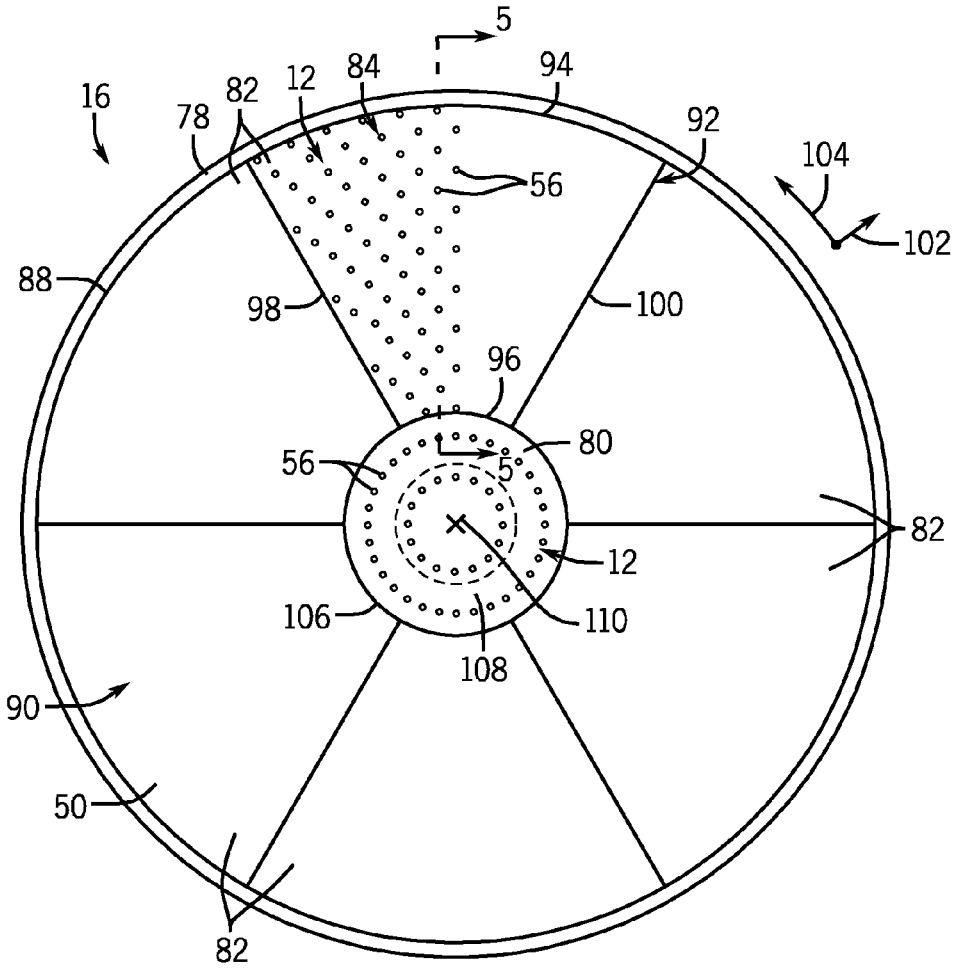
FIG. 4 is a front plan view of an embodiment of the combustor including a plurality of multi-tube fuel nozzles (e.g., truncated pie-shaped)

FIG. 4 is a front plan view of another embodiment of the combustor 16 including multiple fuel nozzles 12 (e.g., multi-tube fuel nozzles). In some embodiments, the combustor 16 may include a cap member 78. A cap member 78 may be disposed circumferentially about the fuel nozzles 12 in direction 104. As illustrated, the combustor 16 may include a center fuel nozzle 80 and multiple outer fuel nozzles 82 disposed circumferentially about the center fuel nozzle 80. As illustrated, six outer fuel nozzles 82 surround the center fuel nozzle 80. However, in certain embodiments, the number of fuel nozzles 12 as well as the arrangement of the fuel nozzles 12 may vary. For example, the number of outer fuel nozzles 82 may be 1 to 20, 1 to 10, or any other number. The fuel nozzles 12 may be tightly disposed within the cap member 78. As a result, an inner perimeter 88 of the cap member 78 defines a circular nozzle area 90 for the combustor 16. In some embodiments, the fuel nozzles 12 may be arranged within the combustor 16 without a cap member 78. The nozzle walls 50 of the fuel nozzles 12 encompass the entire circular nozzle area 90. Each outer fuel nozzle 82 includes a non-circular perimeter 92. As illustrated, the perimeter 92 includes a wedge shape or truncated pie shape with two generally parallel sides 94 and 96. The sides 94 and 96 are arcuate shaped, while sides 98 and 100 are linear (e.g., diverging in radial direction 102). However, in certain embodiments, the perimeter 92 of the outer fuel nozzles 82 may include other shapes, e.g., a pie shape with three sides. The perimeter 92 of each outer fuel nozzle 82 includes a region of the circular nozzle area 90. The center fuel nozzle 80 includes a perimeter 106 (e.g., circular perimeter). In certain embodiments, the perimeter 106 may include other shapes, e.g., a square, hexagon, triangle, or other polygon. The perimeter 106 of the center fuel nozzle 80 is disposed at a central portion 108 of the circular nozzle area 90 centered on the central axis 110 of the combustor 16

Each fuel nozzle 12 includes multiple premixing tubes 56. The premixing tubes 56 are only shown on portions of some of the fuel nozzles 12 in FIG. 4 for clarity. As illustrated, the plurality of tubes 56 of each fuel nozzle 12 are arranged in multiple rows 84. The rows 84 of tubes 56 of the outer fuel nozzles 82 have a concentric arrangement about a central axis 110 of the combustor 16. The rows 84 of tubes 56 of the central fuel nozzle 80 also have a concentric arrangement about the central axis 110 of the combustor 16. In certain embodiments, the number of rows 84, number of tubes 56 per row 84, and arrangement of the plurality of tubes 56 may vary. The fuel nozzles 12 may include at least one of the differential configurations of air intake portions 30 discussed in detail below (e.g., axial air inlets and possibly radial air inlets). In certain embodiments, only the center fuel nozzle 80 may include differential air intake portions 30. Alternatively, in certain embodiments, only the outer fuel nozzles 82 may include differential air intake portions 30. In some embodiments, both the center fuel nozzle 80 and outer fuel nozzles 82 may include differential air intake portions 30.

The differential air intake portions 30 of the plurality of tubes 56 may generate different fuel/air premixing ratios among the plurality of tubes 56. Indeed, the different fuel/air premixing ratios of the plurality of tubes 56 may change (e.g., increase or decrease) in the radial direction 102 away from the central axis 86 of the fuel nozzle 80 or the central axis 110 of the combustor 16. In certain embodiments, the fuel/air premixing ratio may change by approximately 0 to 100, 5 to 50, or 10 to 25 percent from one tube 56 to another in the radial direction 102 due to the differential air intake portions 30. For example, the fuel/air premixing ratio may increase by greater than approximately 1, 2, 3, 4, 5, 6, 7, 8, 9, or 10 percent from one tube 56 to another tube 56 due to differential air intake portions 30. Some tubes 56 may not include fuel inlets, thus only air flows through the tubes 56 and no premixing of air and fuel occurs. As a result, the fuel/air ratio for tube 56 is 0. This lean fuel/air ratio in the area proximate the tube 56 may be much leaner than other areas in the combustion region 54, thereby reducing hot spots in the combustion region 54. In other words, the differential air intake portions 30 create a barrier (e.g., lean air) to reduce combustion in an area of combustion region 54, thereby providing a more controlled heat distribution. As a result, the hot zones may be reduced and the operability and durability of the fuel nozzle 12 is increased.

Furthermore, in other embodiments the differential air intake portions 30 may affect the velocity of the air-fuel mixture exiting each tube 56. As described below, differential air intake portions 30 may decrease the velocity of the air-fuel mixture 32 exiting tubes near the central axis 86 of a fuel nozzle 12 or near the central axis 110 of the combustor 16. More specifically, the differential air intake portions 30 may create a substantially uniform exit velocity profile of the air-fuel mixture 32 injected into the combustor 16.

Figure 5:
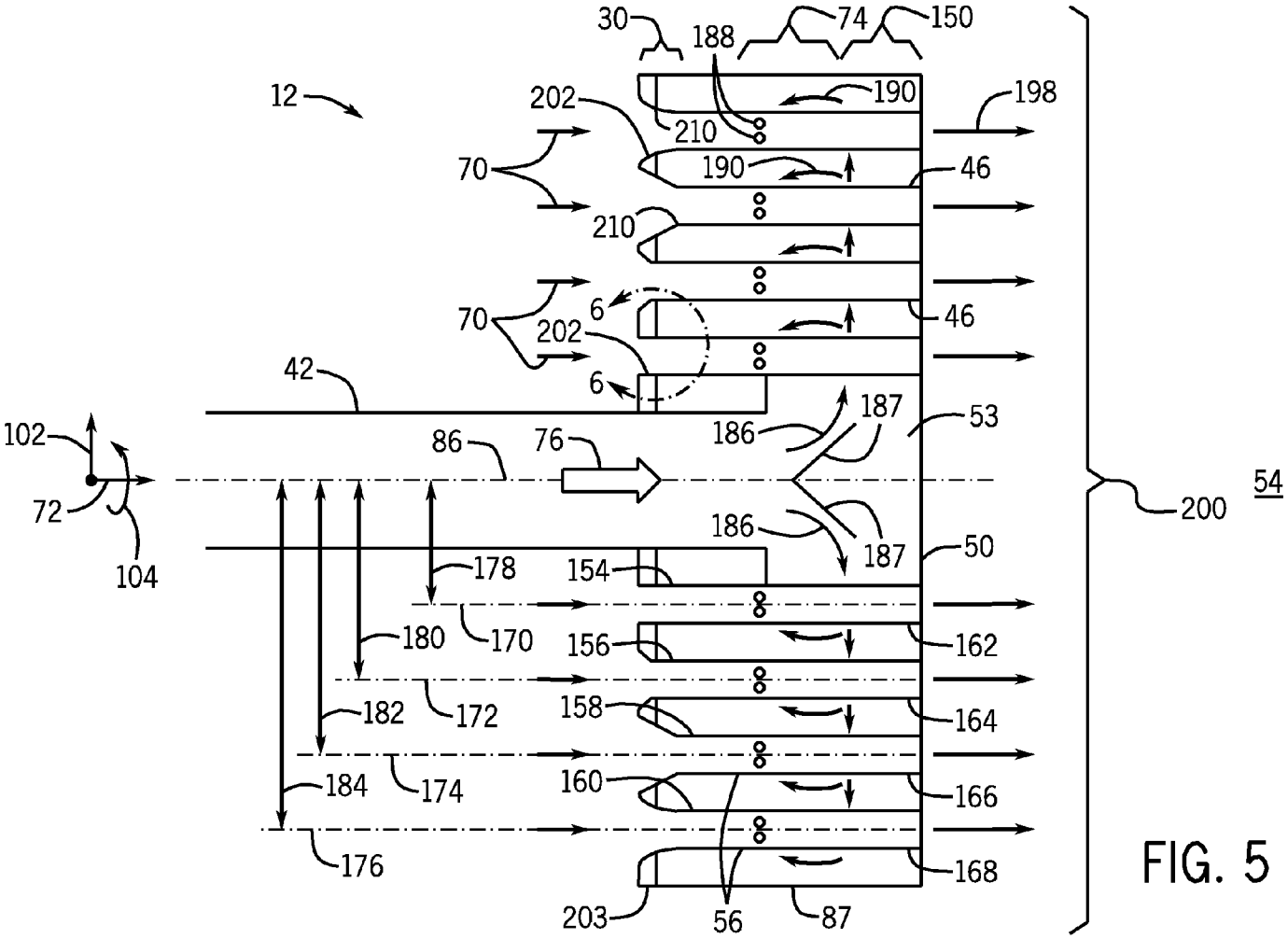
FIG. 5 is a cross-sectional side view of an embodiment of a multi-tube fuel nozzle of FIG. 3 or 4, taken within line 5-5, illustrating a differential configuration of flow control features (e.g., air intake portions) at axial air inlets of a plurality of tubes.

FIG. 5 illustrates a cross-sectional side view of an embodiment of one of the fuel nozzles of FIG. 3 or 4, taken within line 5-5. Each fuel nozzle 12 may include a differential configuration of air intake portions 30 to affect the quantity and/or velocity of air passing through each tube 56, and possibly the quality of the air-fuel mixture 32. Differential configurations of air intake portions may include differential entry shapes of axial air inlets 202 among the multiple tubes 56. For example, a certain differential configuration of air intake portions 30 may reduce low velocity regions or recirculation zones of hot combustion products at the combustion face of each fuel nozzle 12. Another differential configuration may lean or richen certain tubes 56 of each fuel nozzle 12. Air intake portions 30 discussed below are not limited to their respective embodiments and may be used in combination to improve the operability and durability of the fuel nozzle 12.

As discussed above, each fuel nozzle 12 (e.g., multi-tube fuel nozzle) includes the fuel conduit 42, the fuel chamber 52, 53 coupled to the fuel conduit 42, and the plurality of tubes 56 (e.g., 154, 156, 158, and 160) extending through the fuel chamber 52, 53 to the downstream end portion 46. Tubes 154, 156, 158, and 160 as illustrated may each represent concentric rows 84 (i.e., 162, 164, 166, and 168) of tubes 56 disposed about the central axis 86 of the fuel nozzle 12 in a circumferential direction 104. For example, each row 162, 164, 166, and 168 of tubes 56 may represent a plurality of tubes 56 (e.g., 2 to 50 tubes 56) in an annular arrangement or circular pattern or any other suitable configuration. Descriptions of the tubes 56 below may also apply to their respective rows 84. In other words, any discussion of the tubes 56 (e.g., tubes 154, 156, 158, and 160) is intended to include the respective rows 162, 164, 166, and 168 (e.g., multiple tubes per row). Each tube 56 includes an axis (i.e., 170, 172, 174, and 176) disposed at a radial offset (i.e., 178, 180, 182, and 184) from the central axis 86 of the fuel nozzle 12. For example, tubes 154, 156, 158, and 160 include axes 170, 172, 174, and 176, respectively. These axes 170, 172, 174, and 176 are parallel with respect to each other in the illustrated embodiment. However, the axes 170, 172, 174, and 176 may be non-parallel (e.g., converging or diverging) in other embodiments. The radial offsets 178, 180, 182, and 184 increase in the radial direction 102 away from the central axis 86 of the fuel nozzle 12. As a result, the radial offset 184 of tube 160 is greater than the radial offsets 178, 180, and 182 of respective tubes 154, 156, and 158. Similarly, the radial offset 182 of tube 158 is greater than the radial offsets 178 and 180 of respective tubes 154 and 156, and the radial offset 180 of tube 156 is greater than the radial offset 178 of tube 154. In the illustrated embodiment, the radial spacing between tubes 56 is generally constant. However, other embodiments may have non-uniform radial spacing (e.g., increasing or decreasing) of the tubes 56 in the radial direction 102. As illustrated, the fuel nozzle 12 includes four rows 162, 164, 166, and 168. As described below, these tubes 154, 156, 158, and 160 (as well as their respective rows 162, 164, 166, and 168) may be structurally different (e.g., differential air intake portions 30) to provide for different air-fuel mixture flow distributions. Further, in certain embodiments, the number of rows 84, number of tubes 56 per row 84, and the arrangement of the plurality of tubes 56 may vary. For example, the number of rows 84 may range from 2 to 10 or more and the number of tubes 56 per row 84 may range from 3 to 500, 5 to 250, or 10 to 100.

As previously mentioned, air flows along a downstream airflow path 70 in the axial direction 72 through air intake portions 30 into the plurality of tubes 56 of the fuel nozzle 12. In some embodiments, each air intake portion 30 may have an axial air inlet 202 directed into an upstream end 210 of a tube 56 of the fuel nozzle 12. The air intake portions 30 for each row 84 may vary to permit desired quantities and velocities of air 34 to enter the tubes 56 and mix with fuel 14 to form a desired air-fuel mixture profile 200 in the combustion region 54 of the combustor 16. In an embodiment, the air intake portions 30 permit greater quantities and/or velocities of the downstream airflow 70 to enter the tubes 56 as the radial offset increases, thus tubes 56 near the perimeter 87 of the fuel nozzle 12 may have a greater air flow than tubes 56 near the central axis 86 of the fuel nozzle 12 due to a differential air intake portion 30. In another embodiment, the air intake portions 30 near the central axis 86 permit lesser quantities and/or velocities of air to enter tubes 56 as the radial offset increases.

Fuel 14 may flow in the axial direction 72 along the fuel flow path 76 through each fuel conduit 42 towards downstream end 46 near the nozzle wall 50 of each fuel nozzle 12. Fuel 14 may then enter the fuel chamber 52, 53 and be diverted towards the plurality of tubes 56, as generally indicated by arrows 186. In certain embodiments, the fuel nozzle 12 may include baffles 187 to direct fuel flow within the fuel chamber 53. Fuel 14 flows toward fuel inlets 188 of the fuel intake portion 74 of the plurality of tubes 56, as generally indicated by arrows 190 around the tubes 56 passing through the fuel chamber 53, and mixes with air 34 within the plurality of tubes 56. The fuel nozzle 12 injects the air-fuel mixture 32 from the air-fuel mixture outlet portion 150 of the tubes 56, as generally indicated by arrows 198, into a combustion region 54 in a suitable ratio for optimal combustion, emissions, fuel consumption, and power output. The air-fuel mixture 32 injected into the combustion region 54 creates an air-fuel mixture profile 200. The air-fuel mixture profile 200 may be characterized by properties such as fuel/air ratio, mix quality, velocity, mass flow, recirculation zones and stagnation zones. The air intake portion 30 of each tube 56 may affect the properties of the air-fuel mixture profile 200. For example, the air intake portions 30 may vary from one tube 56 to another to control the profile 200, e.g., increasing uniformity of the profile 200 among the plurality of tubes 56.

In some embodiments, the fuel nozzles 12 may have differential configurations of air intake portions 30 configured to control the flow distribution among the plurality of tubes 56. The axial air inlets 202 of the air intake portions 30 may vary among the tubes 56 as shown in FIG. 5. The axial air inlet 202 for each tube 56 may be defined by an inlet plate 203, the respective tube 56, or both. In an embodiment, each tube 56 or row 84 of tubes 56 has an inlet plate 203 that defines at least part of the axial air inlets 202 for the respective tubes 56. In another embodiment, a common inlet plate 203 defines at least part of the axial air inlets 202 for all the tubes 56 of a fuel nozzle 12, or even all the tubes 56 of multiple fuel nozzles 12. The inlet plate 203 may be integral with, fixedly coupled to, or removably coupled to the tubes 56. Replacement of an inlet plate 203 may change the configurations of the axial air inlets 202 for multiple tubes 56 simultaneously, providing for a relatively quick change in the air-fuel mixture profile 200.

As shown in FIG. 5, the inlet plate 203 may provide for differential configurations of axial air inlets 202 among the tubes 202 as discussed in detail below. For example, the innermost tube 154 has a straight (e.g., cylindrical) entry shape 220 that is substantially parallel to its respective axis 170. Tubes 156 and 158 have different tapered (e.g., counterbored and/or conical) entry shapes 204 as described in detail below. Tube 160 has a curved (e.g., bell or horn) entry shape 226 as described in detail below. In an embodiment, a non-uniform downstream airflow 70 may have a greater flow rate near the central axis 86 of the fuel nozzle 12 than the perimeter 87. However, the differential configuration of axial air inlets 202 of tubes 154, 156, 158, and 160 as described above may increasingly permit additional downstream airflow 70 to pass through the tubes 56 as the radial offset 178, 180, 182, and 184 increases, resulting in a uniform air-fuel mixture profile 200.

Figure 6:
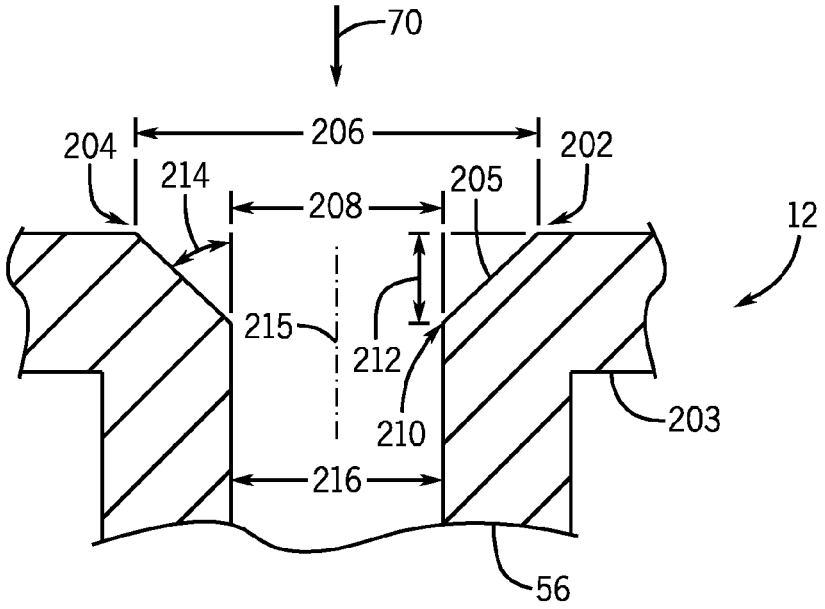
FIG. 6 is a cross-sectional side view of an embodiment of an axial air inlet of one of the tubes of the multi-tube fuel nozzle of FIG. 1-5, illustrating a tapered inlet.

FIG. 6 is a cross-sectional side view of an embodiment of an air intake portion 30 of one of the tubes 56 and respective axial air inlets 202 of FIG. 5, taken within line 6-6. FIG. 6 illustrates an axial air inlet 202 with a tapered entry shape 204, which gradually changes (e.g., decreases) in diameter from an upstream diameter 206 to a downstream diameter 208 (e.g., the upstream diameter 206 is greater than the downstream diameter 208). For example, the tapered entry shape 204 may include a tapered annular outer wall 205, such as a conical surface 205, leading into the tube 56. The tapered entry shape 204 of the axial air inlet 202 may be integral with, fixedly coupled to, or removably coupled to an upstream end 210 of the tube 56. For example, the fuel nozzle 12 may include the inlet plate 203 having axial air inlets 202 for a plurality (e.g., all) of the tubes 56, wherein the axial air inlets 202 may have different entry shapes from one inlet 202 (e.g., tube 56) to another. In such an embodiment, the inlet plate 203 may be coupled to the upstream ends 210 of the tubes 56.

The tapered entry shape 24 may have a depth 212 and an angle 214 relative to an axis 215 of the tube 56. In some embodiments as shown in FIG. 6, the downstream diameter 208 of the tapered entry shape 204 is approximately equal to an inner diameter 216 of the tube 56. In other embodiments, the downstream diameter 208 of the tapered entry shape 204 is greater than the inner diameter 216 of the tube 56. In this embodiment, the tapered entry shape 204 may be a counterbore. The tapered entry shapes 204 may have varying depths 212, diameters 206 and 208, and/or angles 214 from one inlet 202 (and tube 56) to another. For example, the depths 212, diameters 206 and 208, and/or angles 214 may change by approximately 0 to 100, 1 to 50, 2 to 25, or 3 to 10 percent from one inlet (and tube 56) to another. In some embodiments, the angles 214 may be approximately 0 to 90, 1 to 80, 2 to 70, 3 to 60, or 4 to 50 degrees. For example, the angles 214 may be approximately 5 to 60, 10 to 45, or 15 to 30 degrees.

Figure 7:
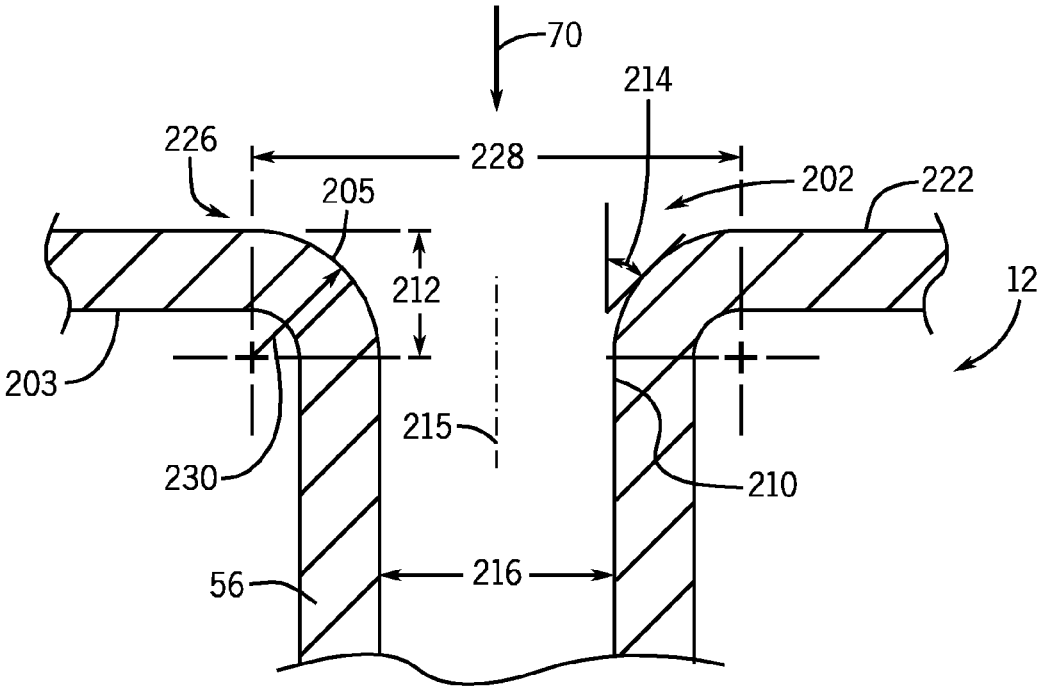
FIG. 7 is a cross-sectional side view of an embodiment of an axial air inlet of one of the tubes of the multi-tube fuel nozzle of FIGS. 1-5, illustrating a curved inlet.

FIG. 7 is a cross-sectional side view of another embodiment of an air intake portion 30 of one of the tubes 56 and respective axial air inlets 202 of FIG. 5, taken within line 6-6. FIG. 7 illustrates an axial air inlet 202 with a curved entry shape 226. Each axial air inlet 202 may have the same or different entry shape. The curved entry shape 226 gradually changes (e.g., decreases) in diameter from an upstream diameter 228 to a downstream diameter 216. The curved entry shape 226 may be shaped like a bell, horn, or the annular portion of a torus such as an ellipse revolved about the axis 215. An embodiment of the curved entry shape 226 may be defined as having an annular outer wall 205 that gradually decreases in angle 214 with the axis 215 of the tube 56 from generally perpendicular to generally parallel (e.g., from tangential with the surface 222 of the inlet plate 203 to tangential with the tube inner diameter 216). The curved entry shape 226 of this embodiment may have multiple radii 230 with an elliptical or parabolic shaped axial air inlet 202. In some embodiments, the curved entry shape 226 may have a single radius 230 with a quarter circle profile as illustrated in FIG. 7. The curved entry shape 226 of the axial air inlet 202 may be integral with, fixedly couple to, or removably coupled to an upstream end 210 of the tube 56 as described above with the tapered entry shape 204. For example, the curved entry shape 226 may be wholly or partially in the inlet plate 203. The axial air inlets 202 including curved entry shapes 226 may vary among the tubes 56 of the fuel nozzles 12 to provide a differential configuration of air intake portions 30 and affect the air-fuel mixture profile 200.

The curved entry shapes 226 may have varying depths 212, outer diameters 228, and/or radii 230 from one inlet 202 (and tube 56) to another. The depths 212, outer diameters 228, and/or radii 230 may change by approximately 0 to 100, 1 to 50, 20 to 25, or 3 to 10 percent from one inlet 202 (and tube 56) to another. Axial air inlets 202 with large outer diameters 228 compared to inner diameters 216 and/or axial air inlets 202 with large depths 212 may permit more of the downstream airflow 70 to pass into the upstream end 210 of respective tubes 56 than axial air inlets 202 with outer diameters 228 approximately equal to the inner diameter 216 or axial air inlets 202 with shallow depths 212.

Figure 8:
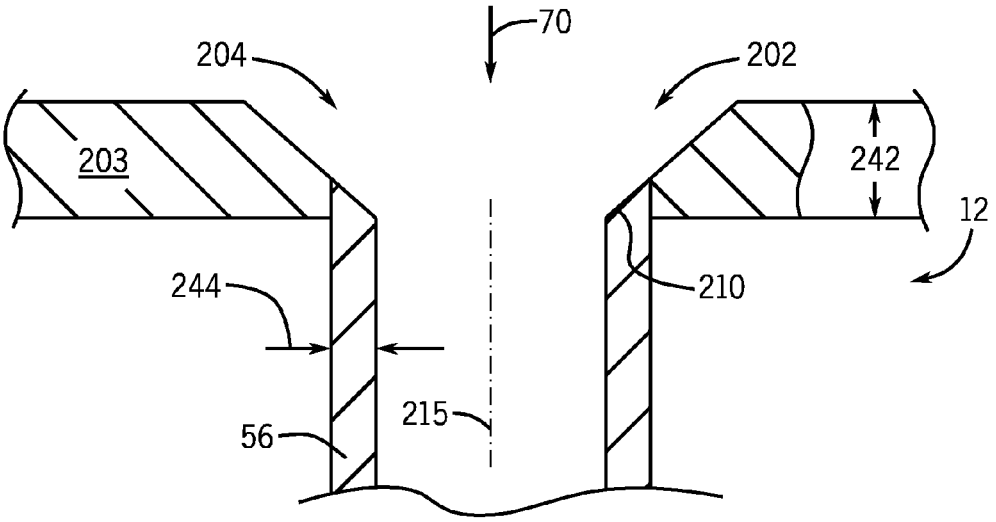
FIG. 8 is a cross-sectional side view of an embodiment of an axial air inlet of one of the tubes and a separate structure of the multi-tube fuel nozzle of FIGS. 1-5, illustrating a tapered inlet.

FIG. 8 is a cross-sectional side view of another embodiment of an air intake portion 30 of one of the tubes 56 and respective axial air inlets 202 of FIG. 5, taken within line 6-6. FIG. 8 illustrates an axial air inlet 202 disposed in an inlet plate 203 at the upstream end 210 of a tube 56. In this embodiment, the air intake portion 30 includes the tapered entry shape 204 extending along the tube 56 and the inlet plate 203. In other embodiments, the air intake portion 30 may include the curved entry shape 226 (see FIG. 7) extending along the tube 56 and the inlet plate 203. In some embodiments, the axial air inlet 202 may be entirely cylindrical through the inlet plate 203, while the axial air inlet 202 has the tapered entry shape 204 or the curved entry shape 226 at the upstream end 210 of the tube 56. In other embodiments, the axial air inlet 202 may be entirely cylindrical at the upstream end 210 of the tube 56, while the inlet plate 203 has the tapered entry tapered entry shape 204 or the curved entry shape 226. The inlet plate 203 may have axial air inlets 202 for one or more tubes 56 of the fuel nozzle 12. The axial air inlets 202 (e.g., tapered entry shape 204) may be disposed entirely within a depth 242 (or thickness) of the inlet plate 203, or within both the depth 242 of the inlet plate 203 and a thickness 244 of the tube 56 as illustrated in FIG. 8. The inlet plate 203 may include tapered entry shapes 204, curved entry shapes 226, or straight entry shapes 220, or combinations thereof. As described above, in some embodiments, each axial air inlet 202 and respective tube 56 may have a separate inlet plate 203. In other embodiments, all or a subset (e.g., row) of the tubes 56 of the fuel nozzle 12 may have a common inlet plate 203. Thus, the differential entry shapes of the axial air inlets 202 may be disposed on one or more structures (e.g., common plate 203) from the plurality of tubes 56.

Figure 9:
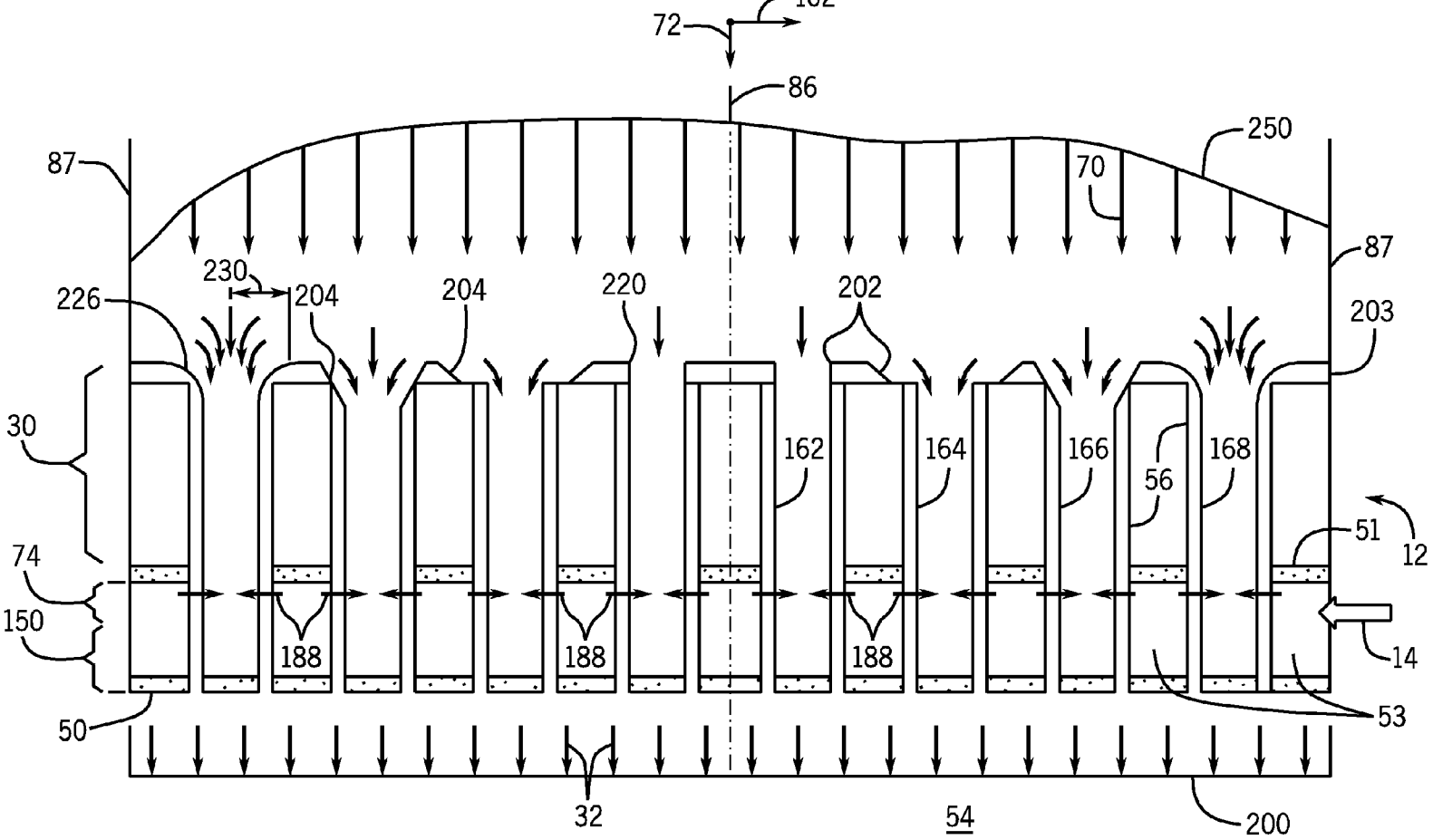
FIG. 9 is a cross-sectional side view of an embodiment of a multi-tube fuel nozzle of FIG. 3 or 4, taken within line 5-5, illustrating a differential configuration of flow control features at axial air inlets of a plurality of tubes.

FIG. 9 illustrates a cross-section of a differential configuration of air intake portions 30, particularly axial air inlets 202, among a plurality of tubes 56 of a multi-tube fuel nozzle 12. FIG. 9 illustrates a downstream airflow path 70 approaching the axial air inlets 202 of the air intake portions 30 for a plurality of tubes 56 of a multi-tube fuel nozzle 12. The downstream airflow path 70 has an entry velocity profile 250 that may be affected by many factors including obstructions within the upstream end portion 44 or downstream end portion 46 of the combustor 16 (e.g., fuel conduits 42, supports, and various obstacles, turns, or changes in flow direction), the entry point 60 of the compressed air 34 into the combustor 16 (e.g., flow sleeve 38, end cover 40), dispersion space within the interior flow path 66, gravity, friction, or other factors, or combinations thereof. The entry velocity profile 250 affects the exit velocity of the air-fuel mixture profile 200 of the air-fuel mixture 32 that enters the combustion region 54. In certain embodiments, a uniform exit velocity of the air-fuel mixture profile 200 entering the combustion region 54 may lead to uniform temperatures across the nozzle wall 50 of the fuel nozzles 12, decreased heat loading on certain tubes 56, uniform combustion, or decreased emissions (e.g., $NO_x$, CO, $CO_2$), or combinations thereof. In some embodiments, the air-fuel mixture 32 of certain tubes 56 may be richened by the respective axial air inlets 202 to act as pilots in the combustion region 54. In other embodiments, the air-fuel mixture 32 of other tubes 56 may be leaned out by the respective axial air inlets 202 to reduce heat loading in critical areas of the combustor 16.

The entry velocity profile 250 may substantially resemble the exit velocity of the air-fuel mixture profile 200 unless the air intake portions 30 affect the airflow between the downstream air path 70 and the nozzle wall 50. An air intake portion 30 may increase the pressure drop and quantity of the downstream air path 70 passing into a respective tube 56 to decrease the exit velocity and quantity of the air-fuel mixture 32 leaving that tube 56. For example, an air intake portion 30 with a large upstream diameter 206, a deep and/or wide angle taper shape 204, or a large radius 230 may affect the pressure drop and quantity of the downstream airflow path 70 passing through to the respective tube 56 more than an air intake portion 30 with a narrow upstream diameter 206, a shallow and/or narrow angle taper shape 204, a small radius 230, or a straight entry shape 220. A narrow upstream diameter 206, a shallow taper shape 204, a small radius 230, or a straight entry shape 220 may increase the pressure drop and decrease the quantity of the air 34 passing through the respective tube 56, leading to a decrease in velocity and quantity of the air-fuel mixture 32 entering the combustion region 54. In this manner, a differential configuration of air intake portions 30 (e.g., from one tube 56 to another) may affect the exit velocity of the air-fuel mixture profile 200 that enters the combustion region 54.

The embodiment illustrated in FIG. 9 shows the downstream airflow path 70 with a lower velocity near the perimeter 87 of the fuel nozzle 12. To create a uniform exit velocity of the air-fuel mixture profile 200, a differential configuration of axial air inlets 202 may decrease the exit velocity of the air-fuel mixture 32 exiting tubes 56 near the central axis 86 of the fuel nozzle 12 more than the tubes 56 near the perimeter 87. For example, in the illustrated embodiment, the axial air inlets 202 of a first row 162 of tubes 56 near the central axis 86 may have a straight entry shape 220 (e.g., cylindrical entry shape). The second row 164 of tubes 56 may have a tapered entry shape 204 (e.g., one or more conical entry shapes) resembling a counterbore, the third row 166 of tubes 56 may have a deep tapered entry shape 204, and the fourth row 168 may have a curved entry shape 226 with a large radius 230. Various configurations of axial air inlets 202 may be utilized for the plurality of tubes 56 to affect the exit velocity of the air-fuel mixture profile 200 that enters the combustion region 54 from the air-fuel mixture outlet portion 150

The fuel 14 to be added to the downstream airflow 70 to form the air-fuel mixture 32 may be injected into fuel intake portion 74 of the tubes 56 through the fuel inlets 188. In an embodiment as shown in FIG. 9, the fuel 14 may enter a fuel chamber 53 of the fuel nozzle 12 substantially perpendicular to the axial direction 72. As discussed above, in some embodiments, the fuel 14 enters the fuel chamber 53 from the axial direction 72. The fuel chamber 53 may be defined by the nozzle wall 50, chamber wall 51, and perimeter 87 of the fuel nozzle 12. In some embodiments, the fuel chamber 53 may be in fluid connection through the fuel inlets 188 to each tube 56 of the fuel nozzle 12. Alternatively, in other embodiments the fuel chamber 53 may be in fluid connection with only some of the tubes 56 (e.g., one or more rows). Furthermore, in some embodiments, substantially the same amount of fuel 14 is injected into each tube 56. In other embodiments, the amount of fuel 14 injected into each tube 56 may be differentially adjusted.

Figure 10:
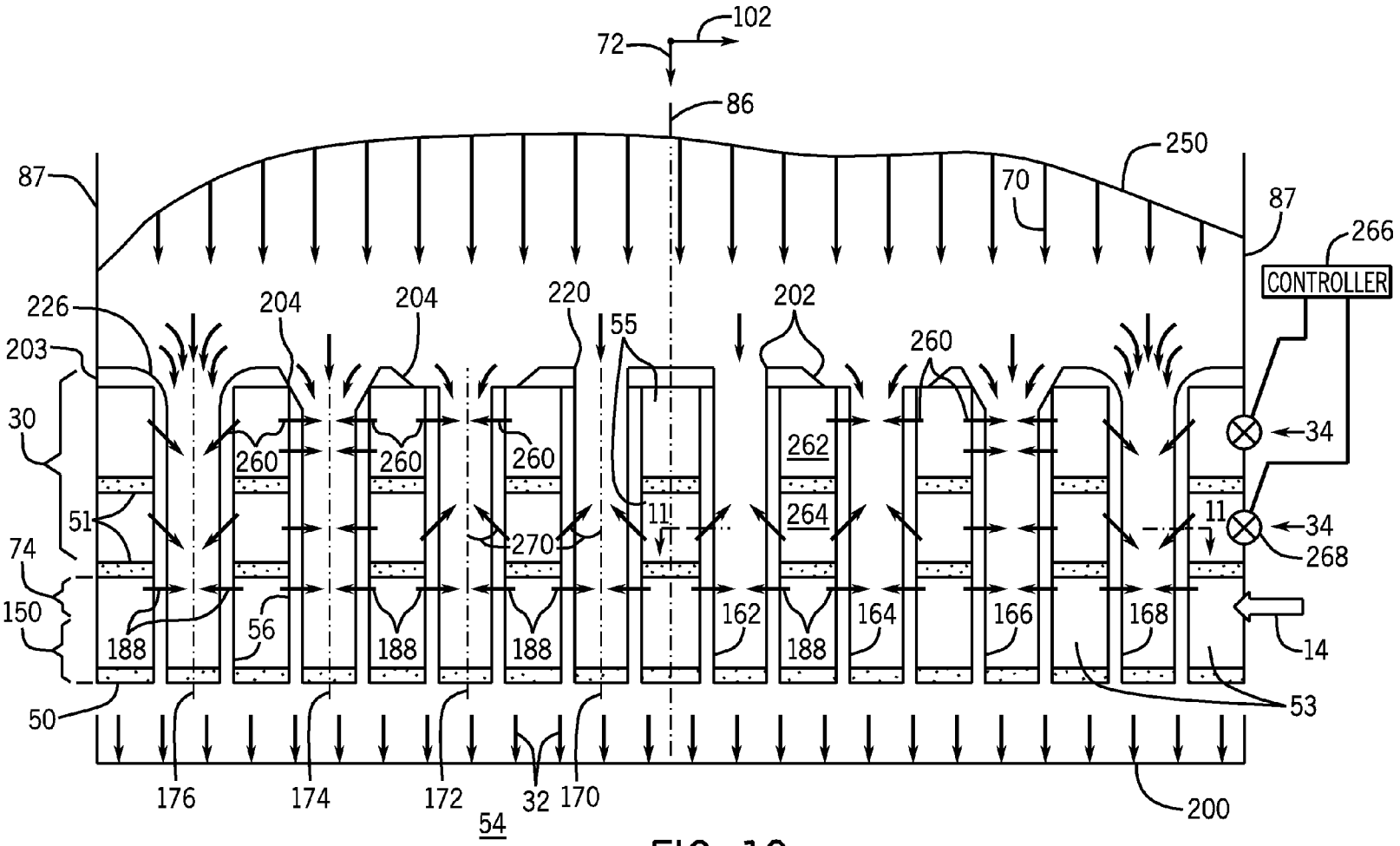
FIG. 10 is a cross-sectional side view of an embodiment of a multi-tube fuel nozzle of FIG. 3 or 4, taken within line 5-5, illustrating multiple air distribution chambers and radial air inlets of a plurality of tubes.

In certain embodiments, the air intake portions 30 may include radial air inlets 260 to affect the exit velocity of the air-fuel mixture profile 200. As illustrated in FIG. 10, air from one or more air distribution chambers 55 may be injected into the plurality of tubes 56 through the radial air inlets 260. In some embodiments, the air distribution chamber 55 may be in fluid connection with each tube 56 through the radial air inlets 260 (e.g., second air distribution chamber 264). In other embodiments, the air distribution chambers 55 may be in fluid connection with only some of tubes 56 (e.g., first air distribution chamber 262). Air 34 injected into an air intake portion 30 of a tube 56 through a radial air inlet 260 may cause additional pressure drop to the airflow 70 passing through the tube 56 and decrease the exit velocity of the air-fuel mixture 32 exiting the air-fuel mixture outlet portion 150 of that tube 56 into the combustion region 54. In some embodiments, the air 34 injected into an air intake portion 30 may increase the quantity of air exiting the tube 56, which may affect the fuel/air ratio of the air-fuel mixture 32. Air 34 injected through the radial air inlets 260 may affect the exit velocity of the air-fuel mixture profile 200 and composition of the air-fuel mixture 32 similar to the axial air inlets 202 discussed above. Fuel 14 may be injected through the fuel inlets 188 into the fuel intake portions 74 of the tubes 56 substantially as described above with respect to FIG. 9.

In some embodiments, the radial air inlets 260 for each tube 56 may be disposed in the air intake portion 30 between the axial air inlets 202 and the fuel inlets 188 of the fuel intake portion 74. In this embodiment, the at least one air distribution chamber 262 may be disposed upstream of the fuel chamber 53 within the fuel nozzle 12. One or more chamber walls 51 may separate the air distribution chamber 262 from other air distribution chambers 264, the fuel chamber 53, and/or other fuel nozzles 12. In other embodiments, the at least one air distribution chamber 262 may be disposed between the fuel chamber 53 and the combustion region 54. In some embodiments, air 34 may enter the at least one air distribution chamber 262 from the perimeter 87 of each fuel nozzle 12. For example, air 34 may enter the air distribution chambers 262, 264 from the upstream airflow path 62 (FIG. 2) near the flow sleeve 38. In some embodiments, air may enter the air distribution chambers 262, 264 from a stage of the compressor 24, a stand alone compressor, a pressure vessel, or another source. Air injected into the tubes 56 through the radial air inlets 260 may be at a higher pressure than the air flowing through the tube 56 by the downstream airflow 70.

In some embodiments, the quantity, pressure, and velocity of air entering the one or more air distribution chambers 262, 264 of each fuel nozzle 12 may be dynamically adjusted. For example, the air 34 supplied to the air distribution chambers 262, 264 may be adjusted to increase the pressure and/or velocity and thus to increase the pressure drop for each tube 56 in fluid connection with the air distribution chambers 262, 264 by a radial air inlet 260. In other embodiments, the quantity of air supplied to the air distribution chamber 262 may be adjusted to affect properties of the air-fuel mixture 32 including the fuel/air ratio. For example, less air may be supplied through the radial air inlets 260 at startup to richen the air-fuel mixture 32, whereas more air may be supplied through the radial air inlets 260 to lean out the air-fuel mixture 32 during operation. The dynamic adjustments may be made by a controller 266, an operator, or a combination thereof, through the operation of valves 268 or other flow regulation devices. In some embodiments, the controller 266 and/or operator may cut off the air supply to the one or more air distribution chambers 262, 264 for a time, thus no air is injected through the radial air inlets 260.

Each configuration of radial air inlets 260, including the number, pattern, size, shape, and radial inlet angle 270, may affect the air-fuel mixture 32 and exit velocity of the air-fuel mixture profile 200 as described in detail below. For example, the differential radial inlet configurations of the radial air inlets 260 may include one or more radial inlet angles, one or more radial inlet sizes, or one or more openings per radial air inlet, or combinations thereof, to affect the air-fuel mixture profile 200. In some embodiments, air 34 may be directed to a first air distribution chamber 262 to supply a first air flow to a first set of radial air inlets 260 of the fuel nozzle 12 to produce a first effect on the air-fuel mixture profile 200 and exit velocity of the air-fuel mixture 32. In some embodiments as illustrated in FIG. 10, air 34 may be directed to a second air distribution chamber 264 to supply a second air flow to a second set of radial air inlets 260 of the fuel nozzle 12 to produce a second effect on the air-fuel mixture profile 200 and exit velocity of the air-fuel mixture 32. As discussed above, the controller 266 and/or operator may dynamically adjust the air 34 supplied to each air distribution chamber 262, 264 to increase or decrease the effect of the injected air 34 on air-fuel mixture profile 200. In some embodiments, air 34 may be supplied to both chambers 262, 264 at once. For example, the first configuration of radial air inlets 260 for the first air distribution chamber 262 may produce a first effect when air 34 is supplied only to the first chamber, and a second configuration of radial air inlets 260 for the second air distribution chamber 264 may produce a second effect when air 34 is supplied only to the second chamber. Air 34 supplied to both the first air distribution chamber 262 and the second air distribution chamber 264 may produce a third effect on the air-fuel mixture profile 200 and exit velocity of the air-fuel mixture 32. Furthermore, each fuel nozzle 12 may include more than one air distribution chamber, such as 2, 3, 4, 5, 6, 7, 8, 9, or 10 air distribution chambers that may be supplied with air 34 to produce a plurality of effects on the air-fuel mixture profile 200 and exit velocity of the air-fuel mixture 32.

Air may be injected into the tubes 56 through various types of radial air inlets 260. As illustrated in FIG. 10, radial air inlets 260 may inject air into tubes 56 at one or more radial inlet angles 270. Such radial inlet angles 270 may be between approximately 0° to 180° with the axis 170, 172, 174, 176 of each tube 56. In certain embodiments, the radial inlet angles 270 for a tube 56 may be approximately 5°, 10°, 20°, 30°, 45°, 60°, 70°, 90°, 110°, 120°, 135°, 150°, 160°, 170°, or 175° with the axis 170, 172, 174, and 176 of the tube 56. The radial inlet angle 270 may affect the pressure drop and velocity of air flowing through the tube 56. For example, radial inlet angles 270 less than 90° (at least partially counter to flow through the tube 56) may decrease the pressure and velocity of air in the tube 56 more than radial inlet angles 270 greater than 90°. Furthermore, tubes 56 may have differential configurations of radial air inlets 260 to affect the exit velocity of the air-fuel mixture profile 200. In this manner, a differential configuration of air intake portions 30 may affect the exit velocity of the air-fuel mixture profile 200 that enters the combustion region 54. In an embodiment, tubes 56 may have differential radial inlet angles 270 for each tube 56 corresponding to each row (e.g., 162, 164, 166, and 168) of tubes 56. In another embodiment, the radial inlet angle 270 for each tube 56 may progressively increase from row 162 to row 168. In some embodiments, tubes 56 near the central axis 86 may have radial inlet angles 270 less than 90° to further decrease the exit velocity of the air-fuel mixture profile 200 near the central axis 86 to create a more uniform air-fuel mixture profile 200 as shown in FIG. 10. For example, the radial inlet angles 270 of rows 162, 164, 166, and 168 out from the central axis 86 may be 15°, 45°, 90°, and 135° respectively. Other examples of radial inlet angles for rows 162, 164, 166, and 168 include, but are not limited to, 30°, 60°, 90°, and 120° respectively or 45°, 45°, 90°, and 90°. In some embodiments, the radial inlet angle 270 of each radial air inlet is 90°.

Figure 13:
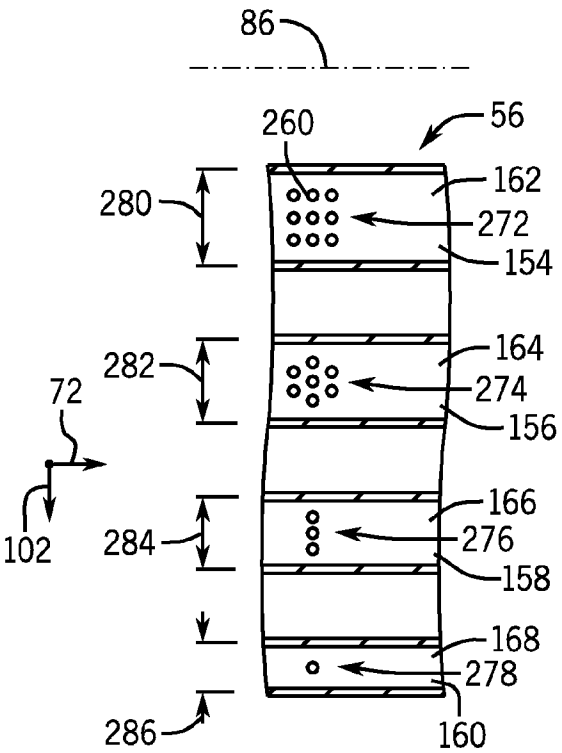
FIG. 13 is a cross-sectional side view of an embodiment of the multi-tube fuel nozzle of FIG. 10, taken within line 11-11.
Figure 12:
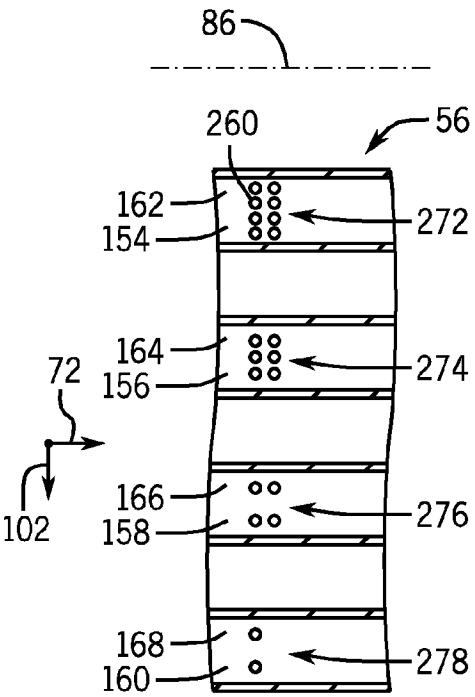
FIG. 12 is a cross-sectional side view of an embodiment of the multi-tube fuel nozzle of FIG. 10, taken within line 11-11.
Figure 11:
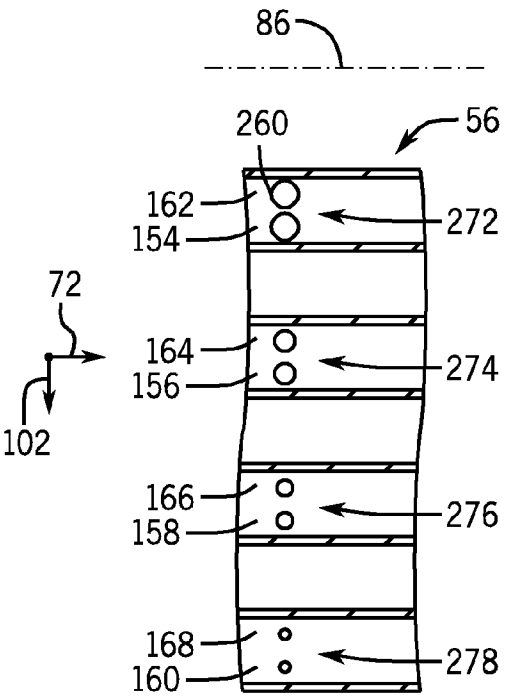
FIG. 11 is a cross-sectional side view of an embodiment of the multi-tube fuel nozzle of FIG. 10, taken within line 11-11.

FIGS. 11-13 are partial cross-sectional side views of the fuel nozzle 12 taken within line 11-11 of FIG. 10, illustrating various features that affect air injected into the plurality of tubes 56. As illustrated in FIGS. 11-13, each tube 56 includes a set of radial air inlets 260. Tubes 154, 156, 158, and 160 include sets 272, 274, 276, and 278 of radial air inlets 260. In certain embodiments, the sets 272, 274, 276, and 278 of radial air inlets 260 may include different shapes (e.g., rectilinear, keyhole, etc.) or arrangements (e.g., different patterns, distributions, positions, etc.) relative to one another. For example, as illustrated in FIG. 11, the radial air inlets 260 on each tube 56 are radially aligned in the radial direction 102 at the same axial position. In certain embodiments, the radial air inlets 260 on each tube 56 may also be aligned one after another in the axial direction 72, or radially and axially aligned with respect to one another (see FIGS. 12 and 13).

As illustrated in FIG. 11, the sets 272, 274, 276, and 278 of the radial air inlets 260 have different sizes relative to one another. The size of the radial air inlets 260 within each set 272, 274, 276, and 278 progressively decreases from tube 154 to tube 160 and, thus, decreases in the radial direction 102 outward from the central axis 86. For example, the size of the set 274 of radial air inlets 260 on tube 156 is less than the size of the set 272 of radial air inlets 260 on tube 154, the size of the set 276 of radial air inlets 260 on tube 158 is less than the size of the set 274 of radial air inlets 260 on tube 156, and the size of the set 278 of radial air inlets 260 on tube 160 is less than the size of the set 276 of radial air inlets 260 on tube 158. For example, the diameter of the radial air inlets 260 may change (e.g., decrease by a factor of approximately 0.1 to 20, 0.1 to 10, or 0.1 to 5 from one tube 56 to another in the radial direction 102. In some embodiments, the diameters of radial air inlets 260 may range from approximately 0.015 inches to 0.04 inches. For example, the radial air inlet diameters may be approximately 0.015, 0.020, 0.023, 0.025, 0.030, and 0.040 inches, or any distance therebetween. As a result of the decreasing radial air inlet sizes, the fuel/air premixing ratios may increase from tube 154 to tube 160 in the radial direction 102. As a result of the decreasing sizes of the radial air inlets 260 on the tubes 56, the air flow within each tube may decrease in the radial direction 102. With a leaner fuel flow outward in the radial direction 102 from the central axis 86 of the fuel nozzle 12 and/or a richer fuel flow towards the central axis 86 of the fuel nozzle 12, the variable size of the radial air inlets 260 may substantially reduce the recirculation region of hot combustion products across the nozzle wall 50 of the fuel nozzle 12. Thus, the variable size of radial air inlets 260 helps to reduce hot spots to increase operability and durability of the fuel nozzle 12. In certain embodiments, only the size of the radial air inlets 260 within set 272 differs and the size of the radial air inlets 260 of the other sets 274, 276, and 278 are the same. In other embodiments, the size of the radial air inlets 260 of both sets 272 and 274 differ from each other and the other sets 276 and 278, while the size of the radial air inlets 260 of sets 276 and 278 are the same.

As illustrated in FIG. 12, the sets 272, 274, 276, and 278 of the radial air inlets 260 include different numbers of radial air inlets 260. In some embodiments, a tube 56 or row 84 of tubes 56 may not have any radial air inlets 260. As illustrated, each set 272, 274, 276, and 278 have a variable number of radial air inlets 260 that changes (e.g., decreases) in the radial direction 102. For example, tube 156 has a lesser number of radial air inlets 260 (e.g., a total of 6) than tube 154 (e.g., a total of 8), tube 158 has a lesser number of radial air inlets 260 (e.g., a total of 4) than tube 156 (e.g., a total of 6), and tube 160 has a lesser number of radial air inlets 260 (e.g., a total of 2) than tube 158 (e.g., a total of 4). The number of radial air inlets 260 within each set 272, 274, 276, and 278 decreases from tube 154 to tube 160 and, thus decreases in the radial direction 102 outward from the central axis 86 to vary the fuel/air ratio in the radial direction 102. For example, the number of radial air inlets 260 may change (e.g., decrease) by approximately 0 to 50, 0 to 20, or 0 to 10 percent from one tube 56 to another in the radial direction 102. For example, the number of radial air inlets 260 may change (e.g., decrease) by at least 1, 2, 3, 4, 5, 6, 7, 8, 9, or 10, or any other number, from one tube 56 to another in the radial direction 102. The decreasing number of radial air inlets 260 on each tube 56 in the radial direction 102 may decrease the velocity of the air flow of tubes 56 near the center axis 86 of the nozzle 12 more than tubes 56 near the perimeter 87, thereby creating a more uniform exit velocity of the air-fuel mixture profile 200. In another embodiment, the number of radial air inlets 260 may increase or decrease in the radial direction 102 from the central axis of the combustor 16, thereby creating a more uniform exit velocity of the air-fuel mixture profile 200. With a more uniform air-fuel mixture profile 200 across the fuel nozzle 12, the variable number of radial air inlets 260 may substantially reduce the recirculation across the nozzle wall 50 of the fuel nozzle 12, thus better distributing the heat across the nozzle wall 50. Thus, the variable number of radial air inlets 260 helps to reduce hot spots to increase operability and durability of the fuel nozzles 12. In certain embodiments, a variable size and number (e.g., decreasing) of radial air inlets 260 may be disposed on the tubes 56 in the radial direction 102. In some embodiments, the number of the radial air inlets 260 within set 272 differs and the number of the radial air inlets 260 of the other sets 274, 276, and 278 are the same. In other embodiments, the number of the radial air inlets 260 of both sets 272 and 274 differ from each other and the other sets 276 and 278, while the number of radial air inlets 260 of sets 276 and 278 are the same.

FIG. 13 illustrates a further embodiment of the plurality of tubes 56. As illustrated, each set 272, 274, 276, and 278 of radial air inlets 260 on the tubes 56 have different numbers of radial air inlets 260 to affect the exit velocity of the air-fuel mixture profile 200 as described above. In addition, the plurality of tubes 56 may have different diameters. Indeed, the plurality of tubes 56 illustrated in FIG. 13 have decreasing diameters in the radial direction 102 away or outward from the central axis 86. Tubes 154, 156, 158, and 160 have diameters 280, 282, 284, and 286, respectively. The tube diameters 280, 282, 284, and 286 may range from approximately 0.05 inches to 0.3 inches. For example, the tube diameters 280, 282, 284, and 286 may be approximately 0.05, 0.1. 0.15, 0.20, 0.25, or 0.30 inches, or any distance therebetween. The tube diameters 280, 282, 284, and 286 decrease in the radial direction 102 from tube 280 to tube 286. For example, the diameter 282 of tube 156 decreases from the diameter 280 of tube 154, the diameter 284 of tube 158 decreases from the diameter 282 of tube 156, and the diameter 286 of tube 160 decreases from the diameter 284 of tube 158. In certain embodiments, the diameter of tubes 56 may change (e.g., decrease) by a factor of approximately 0.1 to 10, 0.1 to 5, or 0.5 to 2 from one tube 56 to another in the radial direction 102. In certain embodiments, an equal amount of air may flow through each tube 56, and thus the decreasing diameters may result in an increasing flow velocity from one tube 56 to another in the radial direction 102. In other embodiments, the decreasing diameters of the tubes 56 may result in a decreasing flow rate from one tube 56 to another in the radial direction 102. In addition, the number of radial air inlets 260 changes (e.g., decreases from one tube 56 to another in the radial direction 102). Thus, in the illustrated embodiment, the combination of variable tube diameters and variable numbers of radial air inlets 260 serve as flow control features to produce a uniform air-fuel mixture profile 200, reduce low velocity regions, or reduce recirculation, thereby reducing the possibility of flame holding, flash back, hot spots, and damage to the fuel nozzle 12. In some embodiments, the flow control features may include variable diameters of the tubes 56, variable numbers of radial air inlets 260, variable sizes of radial air inlets 260, or any combination thereof. In certain embodiments, the different tube diameters of the plurality of tubes 56 may change in the radial direction 102 away from the central axis 86 of the fuel nozzle 12 only up to the first row 162 of tubes 56 (e.g., tubes 154) or at most the second row 164 of tubes 56 (e.g., tubes 156). In some embodiments, the number of the radial air inlets 260 within set 272 differs and the number of the radial air inlets 260 of the other sets 274, 276, and 278 are the same. In other embodiments, the number of the radial air inlets 260 of both sets 272 and 274 differ from each other and the other sets 276 and 278, while the number of radial air inlets 260 of sets 276 and 278 are the same.

Technical effects of the disclosed embodiments include providing the fuel nozzle 12 (e.g., multi-tube fuel nozzle) with different air intake portions 30. The air intake portions (e.g., axial air inlets 202 and/or radial air inlets 260) 30 may change in the radial direction 102 away from the central axis 86 of the fuel nozzle 12 up to certain rows 84 of tubes 56 in the fuel nozzle 12 or in the radial direction 102 away from the central axis 110 of the combustor 16. In particular, the air intake portions 30 may make the air-fuel mixture 32 leaner or provide less contact between the tubes 56 and the flame. For example, the air intake portions 30 may include differential axial air inlets 202 and differential radial air inlets 260. These air intake portions 30 may substantially affect properties of the air-fuel mixture profile 200 such as the exit velocity, thus reducing hot spots to increase operability and durability of the fuel nozzle 12 and reducing emissions (e.g., $NO_x$ emissions).

Differential configurations of air intake portions 30 among the plurality of tubes 56 may include combining the various axial air inlets 202 (e.g., tapered, curved, and/or straight) with the various radial air inlets 260 (e.g., one or more radial inlet angles, one or more radial inlet sizes, and/or one or more openings per radial air inlet). For example FIG. 10, as discussed above, illustrates a differential configuration of air intake portions 30 such that each row (e.g., 162, 164, 166, and 168) of tubes 56 has a different combination of air intake portions 30 to produce a uniform exit velocity of the air-fuel mixture profile 200 despite a non-uniform entry velocity profile 250. In this embodiment, the inner row 162 of tubes 56 has a straight entry shape 220 and one set of two radial air inlets 260 directed at a small (e.g., 15°) radial inlet angle 270. The second row 164 of tubes 56 has an axial air inlet 202 with a tapered entry shape 204 only in the inlet plate 203, a straight entry shape 220 in the tube 56, a first set of two radial air inlets 260 with a perpendicular radial inlet angle 270, and a second set of radial air inlets 260 with a 45° radial inlet angle 270. The third row 166 of tubes 56 has a tapered entry shape 204 through the inlet plate 203 and the tube 56, a first set of four radial air inlets 260 with a perpendicular radial inlet angle 270, and a second set of two radial air inlets 260 with a perpendicular radial inlet angle 270. The fourth row 168 of tubes 56 has a curved entry shape 226 through the inlet plate 203 and the tube 56, and two sets of radial air inlets 260 with two radial air inlets 260 each that are directed into the tubes 56 at a large (e.g., 135°) radial inlet angle 270. In other embodiments, the air intake portions 30 may vary for each tube based at least in part on its location within the combustor 16. For example, a combustor 16 for which nozzles 12 and/or tubes 56 are not arranged in radially or in rows 162, air intake portions 30 may be based at least in part on the disposition (e.g., central, outer, lateral, or vertical position) of the nozzles 12 and/or tubes 56 within the combustor 16. Other differential configurations of air intake portions are envisioned that may include various other combinations of axial air inlets, radial air inlets, inlet plates, and air distribution chambers as described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a multi-tube fuel nozzle, comprising:

a fuel nozzle body comprising a nozzle wall surrounding a fuel chamber, wherein the fuel chamber is fluidly coupled to a fuel conduit; and a plurality of tubes extending through the fuel chamber, wherein each tube of the plurality of tubes comprises an air intake portion, a fuel intake portion disposed downstream of the air intake portion and fluidly coupled to the fuel chamber, and an air-fuel mixture outlet portion, wherein the multi-tube fuel nozzle comprises a configuration of the air intake portions among the plurality of tubes arranged to provide a uniform exit velocity;

wherein each of the air intake portions comprises an axial air inlet directed into an upstream end of a respective tube of the plurality of tubes, wherein the configuration comprises differential entry shapes of the axial air inlets among the plurality of tubes, wherein the differential entry shapes of the axial air inlets comprise at least one each of a tapered entry shape, a curved entry shape, and a straight entry shape.

2. The system of claim 1, wherein the differential entry shapes of the axial air inlets are integral with the plurality of tubes.

3. The system of claim 1, wherein the differential entry shapes of the axial air inlets are disposed on one or more structures separate from the plurality of tubes.

4. The system of claim 3, wherein a common plate has the differential entry shapes of the axial air inlets for the plurality of tubes.

5. The system of claim 1, wherein each of the air intake portions comprises a plurality of radial air inlets.

6. The system of claim 5, wherein the configuration comprises differential radial inlet configurations of the radial air inlets among the plurality of tubes.

7. The system of claim 6, wherein the differential radial inlet configurations of the radial air inlets comprise one or more radial inlet angles, one or more radial inlet sizes, or one or more openings per radial air inlet, or a combination thereof.

8. The system of claim 6, wherein the differential radial inlet configurations of the radial air inlets comprise one or more diameters of the plurality of tubes, one or more radial inlet sizes, one or more radial inlet arrangements, or one or more openings in the radial air inlets, or a combination thereof.

9. The system of claim 5, comprising a controller and a first air distribution chamber disposed about the plurality of tubes, wherein the first air distribution chamber is configured to supply a first air flow to a first set selected from and being a part of the plurality of radial air inlets and wherein the controller is coupled to one or more valves and is configured to adjust the first air flow via control of the one or more valves.

10. The system of claim 9, comprising a second air distribution chamber disposed about the plurality of tubes, wherein the second air distribution chamber is configured to supply a second air flow to a second set selected from and being part of the plurality of radial air inlets and the controller is configured to adjust the second air flow.

11. The system of claim 1, comprising a turbine combustor or a turbine engine having the multi-tube fuel nozzle.

12. A system, comprising:

a multi-tube fuel nozzle, comprising:

a fuel nozzle body comprising a nozzle wall surrounding a fuel chamber, wherein the fuel chamber is fluidly coupled to a fuel conduit; and a plurality of tubes extending through the fuel chamber, wherein the multi-tube fuel nozzle comprises a configuration of air intake portions among the plurality of tubes arranged to provide a uniform exit velocity, and the configuration is configured to control a flow distribution among the plurality of tubes, wherein each of the air intake portions comprises an axial air inlet directed into an upstream end of a respective tube of the plurality of tubes, wherein the configuration comprises differential entry shapes of the axial air inlets among the plurality of tubes, differential radial inlet configurations of radial air inlets among the plurality of tubes, or a combination thereof, wherein the differential entry shapes of the axial air inlets comprise at least one each of a tapered entry shape, a curved entry shape, and a straight entry shapes, wherein each of the axial air inlets is disposed upstream of a fuel inlet of the respective tube, and each of the fuel inlet is fluidly coupled to the fuel chamber.

13. The system of claim 12, comprising a turbine combustor or a turbine engine having the multi-tube fuel nozzle.

14. A method, comprising:

receiving fuel into a plurality of fuel intake portions of a respective plurality of tubes extending through a fuel chamber disposed within a body of a multi-tube fuel nozzle;

receiving air differentially into the plurality of tubes through a respective plurality of air intake portions, wherein the plurality of air intake portions is disposed upstream of the respective plurality of fuel intake portions, wherein the plurality of fuel intake portions are fluidly coupled to the fuel chamber, wherein the multi-tube fuel nozzle comprises a configuration of the air intake portions among the plurality of tubes arranged to provide a uniform exit velocity, wherein each of the air intake portions comprises an axial air inlet directed into an upstream end of a respective tube of the plurality of tubes, wherein the configuration comprises differential entry shapes of the axial air inlets among the plurality of tubes, differential radial inlet configurations of radial air inlets among the plurality of tubes, or a combination thereof, wherein the differential entry shapes of the axial air inlets comprise at least one each of a tapered entry shape, a curved entry shape, and a straight entry shape; and outputting an air-fuel mixture from the plurality of tubes.

* * * * *